US006098802A

United States Patent [19]

Asa et al.

[11] Patent Number: 6,098,802

[45] Date of Patent: Aug. 8, 2000

[54] DEEP WELL RACK ASSEMBLY FOR PIPETTE TIPS AND THE LIKE

[75] Inventors: David Asa; Michael Hoffman, P.O. Box 896, both of Carmel, Calif. 93921

[73] Assignee: Michael Hoffman, Carmel, Calif.

[21] Appl. No.: 09/213,694

[22] Filed: Dec. 17, 1998

Related U.S. Application Data

[60] Provisional application No. 60/077,193, Mar. 5, 1998, and provisional application No. 60/093,401, Jul. 20, 1998.

[51] Int. Cl.[7] ..... B65D 85/20

[52] U.S. Cl. ..... 206/443; 206/562; 206/564

[58] Field of Search ..... 206/443, 562, 206/563, 564, 569; 211/60.1; 422/100, 104

[56] References Cited

U.S. PATENT DOCUMENTS

| | | | |
|---|---|---|---|
| D. 282,208 | 1/1986 | Lowry | D24/55 |
| 3,494,201 | 2/1970 | Roach | 73/425.6 |
| 3,853,217 | 12/1974 | Scordato et al. | 206/223 |
| 4,154,795 | 5/1979 | Thorne | 422/9 |
| 4,314,650 | 2/1982 | Cillario | 206/562 |
| 4,577,760 | 3/1986 | Rainin et al. | 206/508 |
| 5,232,669 | 8/1993 | Pardinas | 422/100 |
| 5,285,896 | 2/1994 | Salatka et al. | 206/366 |
| 5,366,088 | 11/1994 | Hill et al. | 206/499 |
| 5,392,914 | 2/1995 | Lemieux et al. | 206/499 |
| 5,642,816 | 7/1997 | Kelly et al. | 211/60.1 |

FOREIGN PATENT DOCUMENTS 2023103 12/1979 United Kingdom .

*Primary Examiner*—Jim Foster

*Attorney, Agent, or Firm*—Flanagan & Flanagan; John K. Flanagan; John R. Flanagan

[57] ABSTRACT

A deep well rack assembly for pipette tips and the like includes an enclosure having a plurality of openings in a top wall thereof, a plurality of wells in the enclosure extending below the top wall and openings for receiving and retaining pipette tips, and a cover for overlying the top wall of the enclosure and the wells and pipette tips. The top wall of the enclosure either has a plurality of annular depressions formed therein and surrounding the openings or a plurality of raised annular rings formed thereon and surrounding the openings. The wells are disposed within an interior cavity of the enclosure. Each well has a continuous side wall attached at an open top end to the top wall and surrounding one of the openings therein. Each well is adapated to receive a pipette tip such that the pipette tip is disposable within the well and the respective annular depression or raised annular ring of the top wall of the enclosure. The cover can be in the form of a slidable lid or one or more layers of film applied over the top wall of the enclosure and covering the openings and wells and pipette tips therein as well as the annular depressions or raised annular rings of the top wall of the enclosure.

39 Claims, 3 Drawing Sheets

DEEP WELL RACK ASSEMBLY FOR PIPETTE TIPS AND THE LIKE

This application claims the benefit of provisional applications Ser. No. 60/077,193 filed on Mar. 5, 1998 and Ser. No. 60/093,401 filed on Jul. 20, 1998.

BACKGROUND OF THE INVENTION

1. Field of the Invention

The present invention generally relates to racks for pipette tips and, more particularly, is concerned with a deep well rack assembly for pipette tips and the like.

2. Description of the Prior Art

A pipette is an instrument which is commonly used in laboratory settings. Pipettes are typically used in combination with separate tips. Pipette tips are often disposable. Various racks have been developed over the years which organize disposable pipette tips such that the tips can be efficiently placed on pipettes. The racks generally have a support structure which includes a tray defining a plurality of spaced apart holes which are adapted to retain the pipette tips therein. The racks also have a lid which is either hinged to or lifts off the support structure. Pipette tips are generally captured in the holes such that a smaller portion of the axial length of each tip is disposed above and a larger portion of the axial length of each tip is disposed below the tray. The extension of each tip above an upper surface of the tray, however, may cause inefficiencies in packaging the tips and may bring the tips in close proximity to one another such that cross contamination of adjacent tips may occur.

Representative examples of prior art pipette tip racks and the like are disclosed in U.S. Pat. No. 3,494,201 to Roach, U.S. Pat. No. 3,853,217 to Scordato et al., U.S. Pat. No. 4,154,795 to Thorne, U.S. Pat. No. 4,577,760 to Rainin et al., U.S. Pat. No. 5,232,669 to Pardinas, U.S. Pat. No. 5,285,896 to Salatka et al., U.S. Pat. No. 5,366,088 to Hill et al., U.S. Pat. No. 5,392,914 to Lemieux et al., U.S. Pat. No. 5,642,816 to Kelly et al., U.S. Des. Pat. No. 282,208 to Lowry and U.K. Pat. No. 2,023,103 to Cranston et al. While these prior art racks may appear to be satisfactory for the specific purposes for which they were designed, none of them seem to provide an optimum solution for the problems at hand.

Consequently, a need still exists for an assembly which will overcome the aforementioned problems in the prior art without introducing any new problems in place thereof.

SUMMARY OF THE INVENTION

The present invention provides deep well rack assembly designed to satisfy the aforementioned need. The deep well rack assembly of the present invention permits more efficient packaging of pipette tips and more effectively prevents tips from contaminating one another. Such capabilities will solve the aforementioned problem with the prior art designs.

Accordingly, the present invention is directed to a deep well rack assembly for pipette tips, which comprises: (a) an enclosure having a plurality of openings in a top wall thereof for receiving pipette tips; and (b) a plurality of wells in the enclosure extending below the top wall and the openings for receiving and retaining pipette tips. The top wall of the enclosure has either a plurality of annular depressions formed therein and surrounding the openings or a plurality of raised annular rings formed thereon and surrounding the openings. The wells are disposed within an interior cavity of the enclosure. Each well has a continuous side wall attached at an open top end to the top wall and surrounding one of the openings therein. Each well is adapted to receive a pipette tip such that the pipette tip is disposable within the well and the respective annular depression or raised annular ring of the top wall of the enclosure.

The deep well rack assembly also includes a cover for overlying the top wall of the enclosure and the wells and pipette tips. The cover can be in the form of a slidable lid or one or more layers of film applied over the top wall of the enclosure and covering the openings and wells and pipette tips therein as well as the annular depressions or raised annular rings of the top wall of the enclosure.

The present invention also is directed to a deep well rack assembly for pipette tips, which comprises: (a) an enclosure having a top wall and a plurality of openings defined through the top wall; (b) a plurality of wells disposed within the enclosure and extending below the top wall of the enclosure, each of the wells including a continuous side wall having an open top end extending around a respective one of the openings in the top wall of the enclosure; (c) a cover lying flush with and overlying a top surface of the top wall of the enclosure and overlying the openings and wells so as to cover the top wall of the enclosure and wells and thereby prevent cross-contamination between the wells; and (d) a plurality of pipette tips each disposed wholly within one of the wells below the top surface of the top wall and covered by the cover.

The present invention further is directed to a deep well rack assembly, which comprises: (a) an enclosure including a plurality of substantially similar block units each including opposite top and bottom, opposite sides and opposite ends and at least one interior continuous side wall defining a passage open at and extending between the top and bottom of the block unit for receiving a pipette tip such that the pipette tip is disposed wholly below the top of the block unit and extends through and outwardly from the passage below the bottom of the block unit; and (b) means for attaching the block units to one another.

The present invention still further is directed to a deep well rack assembly for pipette tips, which comprises: (a) a lower enclosure base having an upper wall with a plurality of openings defined therein; (b) a plurality of lower wells disposed within the lower enclosure base and being attached to and extending below the upper wall of the lower enclosure base, each of the lower wells including a continuous side wall having an open top end extending around a respective one of said openings in the upper wall of the lower enclosure base; (c) an upper enclosure insert having a top wall with a plurality of openings defined therein; and (d) a plurality of upper wells disposed within the upper enclosure insert and being attached to and extending below the top wall of the upper enclosure insert, each of the upper wells including a continuous side wall having an open top end extending around a respective one of the openings in the top wall of the upper enclosure insert, the upper enclosure insert being removably installable over the lower enclosure base with the upper wells of the upper enclosure insert nestably received into the lower wells of the lower enclosure base.

These and other features and advantages of the present invention will become apparent to those skilled in the art upon a reading of the following detailed description when taken in conjunction with the drawings wherein there is shown and described illustrative embodiments of the present invention.

BRIEF DESCRIPTION OF THE DRAWINGS

In the following detailed description, reference will be made to the attached drawings in which.

DETAILED DESCRIPTION OF THE INVENTION

Figure 1:
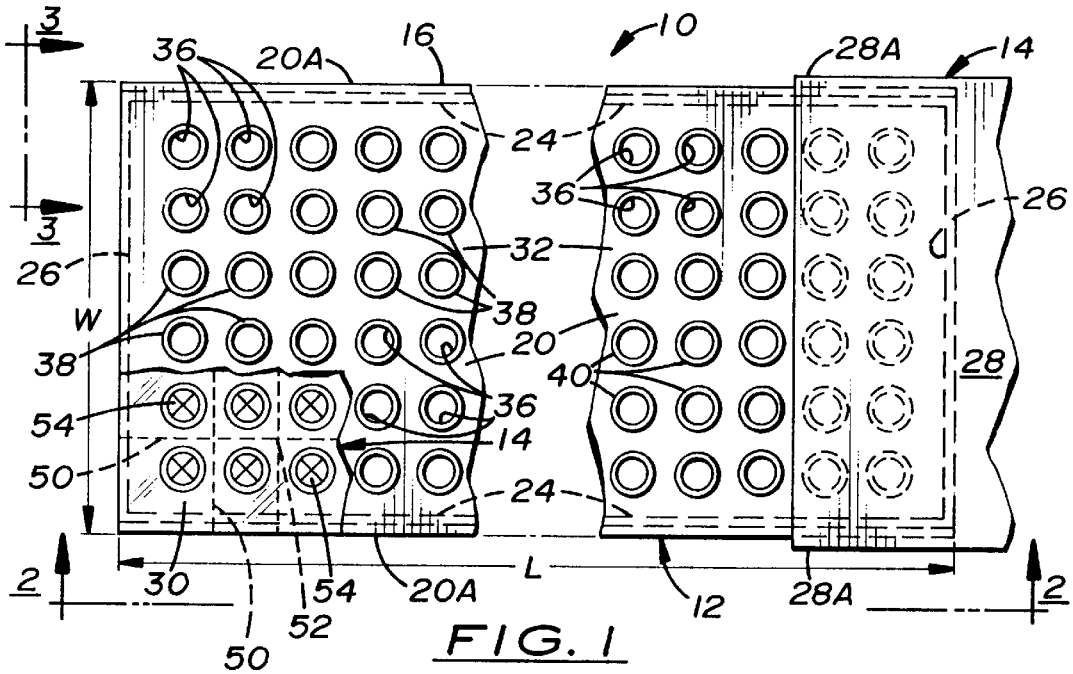
FIG. 1 is a fragmented top plan view of a preferred embodiment of a deep well rack assembly of the present invention showing two alternate covers thereof, one being a slidable lid and the other being a layer of film.

Referring to the drawings and particularly to FIGS. 1 to 4 and 11, there is illustrated a deep well rack assembly, generally designated 10, of the present invention. Basically, the deep well rack assembly 10 includes a support structure 12 for retaining a plurality of pipette tips P and a cover 14 for overlying the pipette tips P. The support structure 12 includes an enclosure 16 and a plurality of wells 18. The enclosure 16 has opposite top and bottom walls 20, 22, opposite side walls 24 and opposite end walls 26, all fixedly attached to one another and providing the enclosure 16 with a substantially box-like rectangular configuration and defining an interior cavity 27. The cover 14 can be in the form of a slidable lid 28 or a layer of film 30.

Figure 4:
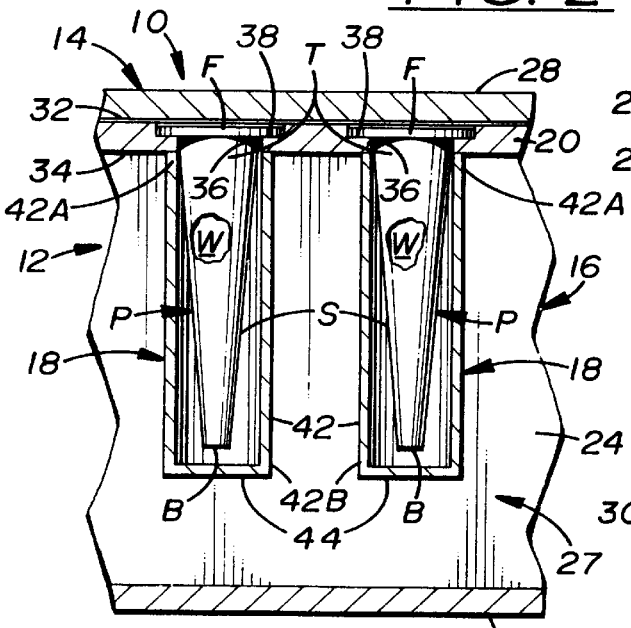
FIG. 4 is an enlarged sectional view of the assembly showing the top wall of the enclosure defining openings and annular depressions therein surrounding the openings and wells extending therefrom and covered by the slidable cover of the assembly and showing pipette tips disposed within the wells.
Figure 11:
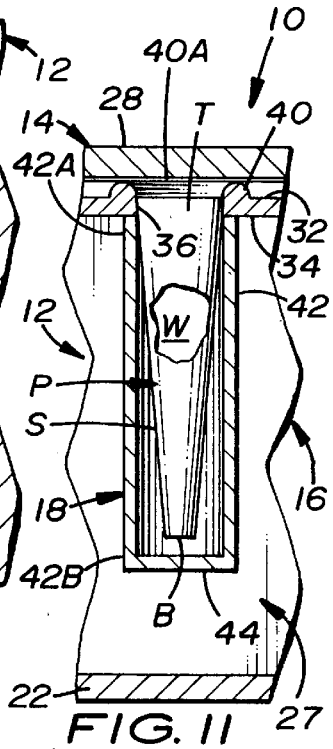
FIG. 11 is a sectional view of the assembly similar to that of FIG. 4 but showing the top wall of the enclosure defining openings and raised annular rings thereon surrounding the openings and wells extending therefrom and covered by the slidable lid of the assembly and with pipette tips disposed within the wells.

The top wall 20 of the enclosure 16 has opposite exterior and interior surfaces 32, 34 and a plurality of openings 36 defined therethrough between the exterior and interior surfaces 32, 34. The top wall 20 also has a length L and a width W. The openings 36 of the top wall 20 are spaced apart from one another and preferably arranged in rows and columns respectively across the length L and the width W of the top wall 20. The openings 36 can also be arranged in any other suitable configuration. Each opening 36 has a substantially circular configuration although other configurations are possible. Each opening 36 has a diameter of any suitable size to accommodate pipette tips P of various sizes. The top wall 20 also has either a plurality of annular depressions 38 formed therein, as seen in FIG. 4, or a plurality of raised annular rings 40 formed thereon, as seen in FIG. 11. Each annular depression 38 or raised annular ring 40 surrounds one of the openings 36 of the top wall 20. Each annular depression 38 or raised annular ring 40 has any suitable size. There is only one annular depression 38 or raised annular ring 40 for each opening 36. Alternatively, the annular depression 38 or raised annular rings 40 may have a stepped configuration and have multiple portions at different elevations for accommodating pipette tips P of different sizes.

The wells 18 are disposed within the interior cavity 27 of the enclosure 16 of the support structure 12. The wells 18 are supported from and extend below the interior surface 34 of the top wall 20 of the enclosure 16. Each well 18 preferably has a continuous side wall 42 with an open top end 42A and a bottom wall 44 attached to one and closing a bottom end 42A of the side wall 42. The side wall 42 may have a substantially cylindrical configuration, though need not be so limited. The open top end 42A of the well side wall 42 extends around one of the openings 36 of the enclosure 16 and underlies the respective annular depression 38 or raised annular ring 40 of the top wall 20 of the enclosure 16 surrounding the one opening 36 of the enclosure 16. Each well 18 is for receiving a pipette tip P such that the pipette tip P is disposable wholly within the well 18 and within the respective annular depression 38 or raised annular ring 40 of the top wall 20 of the enclosure 16. The wells 18 are spaced apart from one another in the same arrangement as the openings 36 of the top wall 20 of the enclosure 16 of the support structure 12. The bottom wall 44 and continuous side wall 42 together give the well 18 a cup-like tubular configuration, although the well 18 is not limited to such a configuration. Each well 18 is open at the top end 42A of its continuous side wall 42 adjacent to the opening 36 in the top wall 20 so as to receive the pipette tip P which is inserted through the opening 36. The wells 18 thus isolate the pipette tips P from one another in the enclosure 16.

As is conventional, each pipette tip P is hollow and of a tapered shape and has a large open top T, a small open bottom B and a continuous side wall S which defines an interior passageway w extending between the open top T and open bottom B and converges or tapers from the top T to the bottom B. The pipette tip P may or may not have an annular flange F surrounding and projecting radially outwardly from the top T thereof. If the pipette tip P has a top annular flange F, as shown in FIG. 4, the bottom B of the pipette tip P is suspended above the bottom wall 40 of the well 18 of the support structure 12. In this embodiment, the well 18 has a height which locates the top T of the pipette tip P at an elevation of the respective annular depression 38 of the top wall 20 of the enclosure 16 with the depression 38 providing a seat for receiving the top annular flange F of the pipette tip such that the pipette tip P is substantially enclosed in the well 18 and such that the top T of the pipette tip P is flush with the top wall 20. If the pipette tip P does not have a top annular flange F, the bottom B of the pipette tip P can rest on the bottom wall 40 of the well 18 within which the respective pipette tip P is disposed. In this embodiment, the well 18 has a height which locates the top T of the pipette tip P at an elevation below the top wall 20 of the enclosure 16 and such that the pipette tip P is disposable wholly within the well 18. The depths of the annular depressions 38 or raised annular rings 40 and the top annular flanges F of the pipette tips P can be substantially the same so that the top annular flanges F, preferably, do not project above a top surface 20A of the top wall 20 of the enclosure 16 in the case of the annular depressions 38 or above top surfaces 40A of the raised annular rings 40. In each of the above embodiments of the well 18, the pipette tips P are substantially enclosed within the wells 18 such that their tops T are flush with or below the top wall 20 of the enclosure 16 or the raised annular rings 40 so that the cover 14 may closely overlie the top wall 20 and, preferably, lie flat on portions of the top wall 20 between the openings 36 of the top wall 20 or may closely overlie and lie flat on the top surfaces 40A of the raised annular rings 40. In such manner, the cover 14 may prevent cross-contamination of the pipette tips P which are disposed in the separate spaced apart wells 18. The wells 18 may be formed to have any depth suitable for receiving the pipette tips P, either with or without the top annular flange F, or any length. Also, the continuous side wall 42 of the well 18 has an interior surface 42A. The well 18 may include one or more vertical ribs 46 formed on the interior surface 42A of the continuous side wall 42 of the well 18 for enhancing support of the pipette tip P disposed within the well 18 thereof, as shown in FIG. 6.

Figure 2:
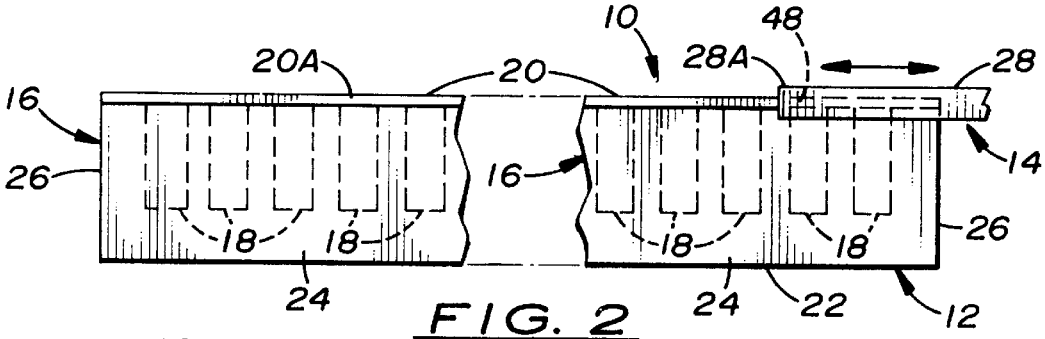
FIG. 2 is a side elevational view of the assembly as seen along line 2—2 of FIG. 1 with an arrow showing the possible directions of movement of the slidable lid.
Figure 3:
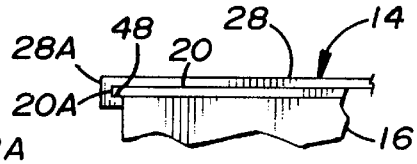
FIG. 3 is a fragmentary end elevational view of the slidable lid engaging a side edge of a top wall of an enclosure of the assembly as seen along line 3—3 of FIG. 1.

The cover 14 is for lying flush with the top wall 20 of the enclosure 16 of the support structure 12 and overlies the pipette tips P disposed wholly within the wells 18 of the support structure 12 and the respective annular depressions 38 or raised annular rings 40 of the top wall 20 and thereby, as mentioned in the previous paragraph, prevents the cross-contamination of the pipette tips P disposed in separate wells 18. The cover 14 may be the slidable lid 28, as shown in FIGS. 1 to 4. The slidable lid 28 has a substantially flat and rectangular configuration. The top wall 20 of the enclosure 16 has opposite side edges 20B. The slidable lid 28 has opposite inturned side ledges 28A. Each side ledge 28A of the slidable lid 28 has a substantially U-shaped configuration and defines a groove 48 which captures one of the side edges 20B of the top wall 20, as shown in FIG. 3. The side ledges 28A are slidably movable along the side edges 20B of the top wall 20 as the lid 28 is slidably moved relative to the top wall 20. The slidable lid 28 may slide relative to the top wall 20 of the enclosure 16 such that only a portion of the wells 18 are exposed at a time, as shown in FIGS. 1 and 2.

Figure 5:
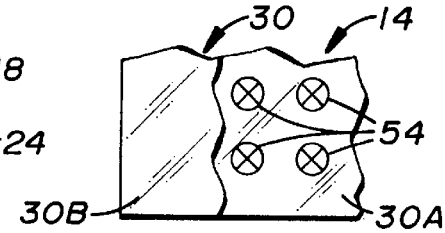
FIG. 5 is a fragmentary top plan view of the cover of the assembly in the form of the layer of film having first and second membrane layer portions with the second membrane layer portion being peelable from the first membrane layer portion and a plurality of targets printed on the first membrane layer portion for marking locations where the film should be pierced to access the wells.
Figure 6:
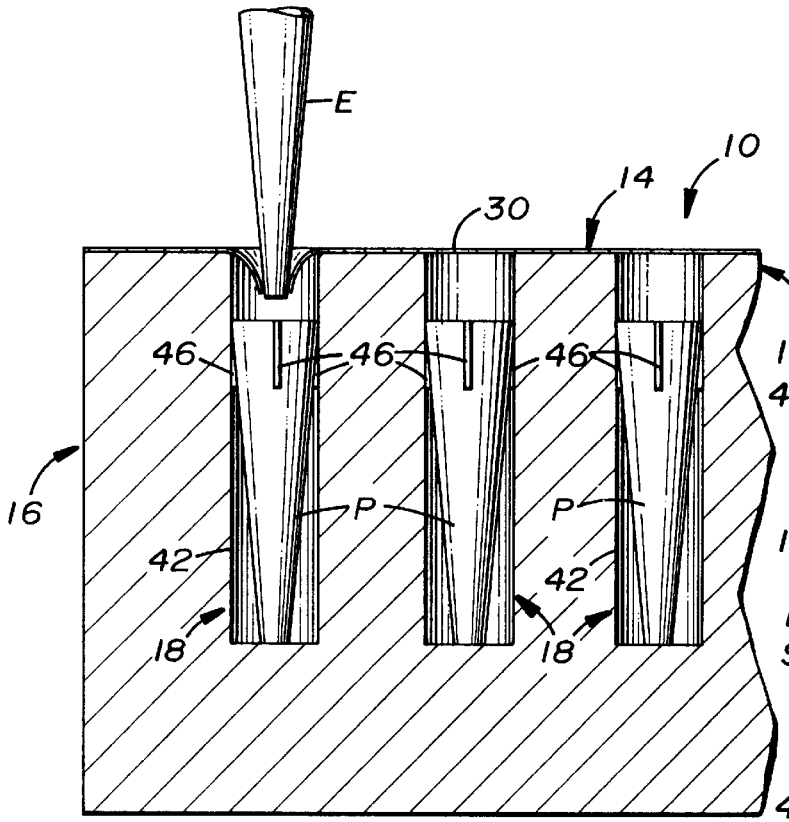
FIG. 6 is an enlarged sectional view of an alternative embodiment of the assembly showing the top wall of the enclosure without the annular depressions and pipette tips disposed within the wells below the top wall of the enclosure.

Alternatively, the cover 14 may be a layer of film 30, as shown in FIGS. 1, 5 and 6. The layer of film 30 is comprised of a substantially autoclave resistant material, such as any suitable packaging film including, but not limited to, metal foil, polypropylene, Mylar, polyesters and polyethylene. The layer of film 30 is applied over and attached, such as along dashed lines 50 in FIG. 1, to portions of the top wall 20 of the enclosure 16 of the support structure 12 between wells 18 of the support structure 12 to ensure sterility of each of the pipette tips P disposed within the wells 18 until the pipette tip P is used. The attachment 50 may be made by welding the layer of film 30 to the top wall 20 by using ultrasonic or heat energy. The attachment 50 may also be made by chemical adhesion, such as by employment of glue, epoxy or other interfacing molecular interaction, between the layer of film 30 and the top wall 20. The attachment 50 may also be made by any form of physical attachment which keeps the layer of film 30 flat and in contact with the top wall 20 in a contiguous manner at the intersections 52 between the wells 18. The layer of film 30 should be attached so as to maintain tension across the top wall 20.

The layer of film 54 can have a plurality of targets 54 printed thereon, as shown in FIG. 1. Each target 54 is disposed directly above one of the wells 18 and thereby marks a location where the layer of film 30 should be pierced with an end of a pipette E to access the one well 18 such that the pipette tip P may be fitted onto the end of the pipette E. The targets 54 allow a user to easily find a well 18 and therefore a pipette tip P. The layer of film 30 is sufficiently thin to permit the user to easily pull the pipette tip P back through the pierced portion of the layer of film 30. The distance between the top T of the pipette tip P and the top wall 20 may be an amount sufficient to ensure that when the pipette is fitted with the tip P the fractured portions of the layer of film 30 do not become forced into an area between an interior of the tip P and an exterior attaching surface of the pipette, as shown in FIG. 6. As one example, the distance might be at least one pipette tip diameter or greater below the top wall 20 of the enclosure 16.

The layer of film 30 can have multiple layer portions such as a first membrane layer portion 30A applied on the top wall 20 of the enclosure 12 and a second membrane layer portion 30B disposed over and attached to the first membrane layer portion 30A, as depicted in FIG. 5. The first and second membrane layer portions 30A, 30B may be releasably attached to one another by any suitable means of heat, chemical or physical attachment whereby the wells 18 of the support structure 12 can be covered by the first membrane layer portion 30A with the second membrane layer portion 30B attached to the first membrane layer portion 30A such that the second membrane layer portion 30B can be removed without disrupting the first membrane layer portion 30A. The first membrane layer portion 30A can have the plurality of targets 54 printed thereon. The second membrane layer portion 30B may be peeled away from the first membrane layer portion 30A after which the first membrane layer portion 30A may be pierced by the end of the pipette E such that the pipette tip P disposed in the well 18 therebelow is fittable on the end of the pipette E. The second membrane layer portion 30B maintains sterility of the first membrane layer portion 30A where the second membrane layer portion 30B has not yet been peeled away from the first membrane layer portion 30A. The second membrane layer 30B thereby maintains sterility of the pipette tips P disposed in the wells 18 therebelow. The sterility of the first membrane layer 30A is critical since the end of the pipette E will pierce the first membrane layer portion 30A in order to attach the pipette tip P to the pipette E. Sandwiching of the layer portions 30A, 30B can be accomplished using generally known methods used in the film and packaging industries. Ultrasonic welding is a preferred method of attachment wherein the first membrane layer portion 30A is welded to the top wall 20 and the second membrane layer portion 30B is spot-welded to the first membrane layer portion 30A. The purpose for this is to allow the second membrane layer portion 30B to adequately cover the first membrane layer portion 30A and yet be easily removable from the first membrane layer portion 30A. To further facilitate the removal of the second membrane layer portion 30B from the first membrane layer portion 30A, the second membrane layer portion 30B may have a tab (not shown) formed at an end thereof for the user to grasp in peeling away the second membrane layer 30B.

The enclosure 16 and the wells 18 of the support structure 12 may have suitable additional openings (not shown) therein to allow introduction of steam therein for circulation throughout the enclosure 16 for sterilizing the pipette tips P mounted therewithin. The cover 14 may also be hinged rather than slidably attached to the top wall 20 of the enclosure 16. The wells 18 and the cover 14 may also be employed with other laboratory and non-laboratory assemblies including, but not limited to, multiwell test plates.

Figure 7:
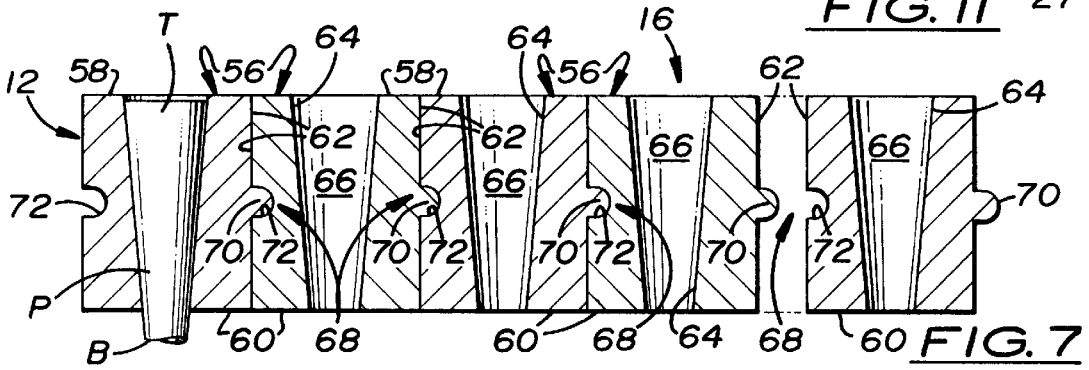
FIG. 7 is a sectional view of an alternative embodiment of the assembly showing the enclosure including a plurality of block units each defining a passage open at and extending between a top and a bottom of the block unit and mateable attachment elements for attaching the block units together to form a continuous structure, also showing a pipette tip disposed within the passage of one block unit.
Figure 8:
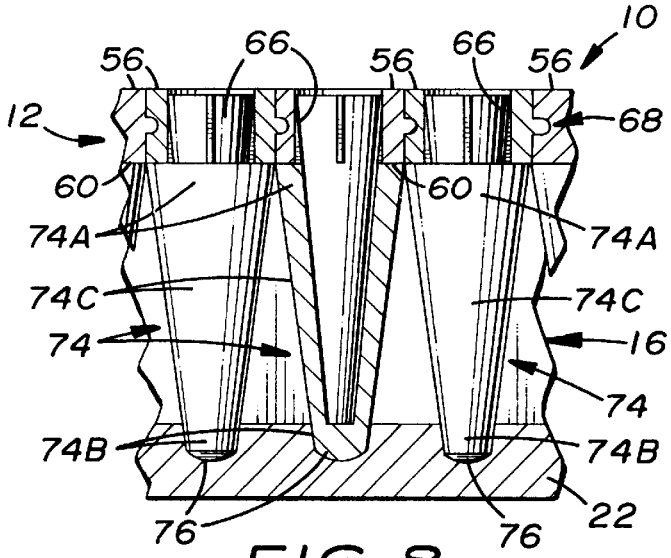
FIG. 8 is a sectional view of an alternative embodiment of the assembly showing tubular structures supported from and extending below bottoms the block units of the enclosure of the assembly.
Figure 9:
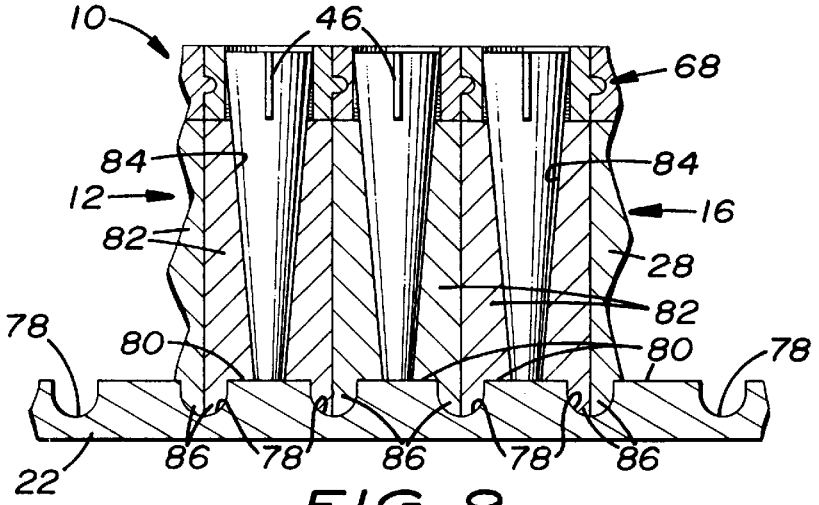
FIG. 9 is a sectional view of an alternative embodiment of the assembly showing a plurality of channels defined by a bottom wall of the enclosure running in parallel relation to one another and a plurality of shoulders each extending between and disposed at an elevation higher than adjacent channels forming bottoms of wells defined by a plurality of support members extending below the bottoms of the block units.

Referring now to FIGS. 6 to 10, the assembly 10 of the present invention can take other forms. The support structure 12 can have a solid block-like construction, as shown in FIG. 6, instead of the box-like enclosure 16 described above. Also, as shown in FIGS. 7 to 9, the enclosure 16 can be a plurality of substantially similar block units 56. Each of the block units 56 includes a top 58, a bottom 60, opposite sides 62, and opposite ends (not shown) and at least one interior continuous side wall 64 defining a passage 66 open at and extending between the top 58 and the bottom 60 of the block unit 56. The passage 66 is adapted for receiving the pipette tip P such that the pipette tip P is disposable wholly below the top 58 of the block unit 56 and extends through and outwardly from the passage 66 below the bottom 60 of the block unit 56. The block unit 56 has a substantially rectangular configuration. The block unit 56 has any suitable size. The block unit 56 can be comprised of a substantially resilient material, such as plastic. The passage 66 defined by the interior continuous side wall 64 tapers from the top 58 to the bottom 60 of the block unit 56 so as to be an inverted open-ended cone-shaped configuration. One or more of the passages 66 can be provided in each block unit 56. The block unit 56 may include one or more vertical ribs 46, as shown in FIGS. 8 and 9, formed on the interior continuous side wall 64 thereof for enhancing support of the pipette tip P disposed through the passage 66 thereof.

The support structure 12 of the embodiment of the assembly 10 shown in FIGS. 7 to 9 also includes attaching means 68 for attaching multiple block units 56 of the enclosure 16 to one another. The attaching means 68 are defined on the opposite sides 62 of the block units 56 in the form of pairs of complementary mateable male and female attachment elements 70, 72. The male attachment element 70 is defined on one of the opposite sides 62 and the female attachment element 72 is defined on the other of the opposite sides 62. The male attachment element 70 of one block unit 56 is mateable with the female attachment element 72 of an adjacent block unit 56 so as to form a continuous structure for supporting multiple pipette tips P. The male attachment element 70 is, particularly, a convex protrusion whereas the female attachment element 72 is, particularly, a concave recess. The size of the concave recess is slightly greater than the size of the convex protrusion for snugly fitting the convex protrusion therein. The male and female attachment elements 70, 72 may also have any other suitable shape and size.

The support structure 12 of the assembly 10 may also include one or more tubular wells 74, as shown in FIG. 8. Each tubular well 74 is supported from and extends below the bottom 60 of the block unit 56 of the enclosure 16. The well tubular well 74 has an upper end 74A, a lower end 74B and a continuous side wall 74C extending between and integral with the upper and lower ends 74A, 74B. The tubular structure 74 is a continuous molded part. The upper end 74A is disposed about the passage 66 at the bottom 60 of the block unit 56. The continuous side wall 74C tapers from the upper end 74A to the lower end 74B. The tubular well 74 is for receiving a pipette tip P such that the pipette tip P is disposable wholly within the passage 66 of the block unit 56 and within the tubular well 74. The bottom wall 22 of the enclosure 16 of the support structure 12 may define a plurality of depressions 76 therein for receiving and supporting the lower ends 74B of the tubular wells 74.

As seen in FIG. 9, the bottom wall 22 of the enclosure 16 of the support structure 12 may also define a plurality of channels 78 running in substantially parallel relation to one another and a plurality of shoulders 80 each extending between and disposed at an elevation higher than adjacent channels 78. The support structure 12 may also include a plurality of support members 82 extending between the block units 56 and bottom wall 22 of the enclosure 12. The support members 82 have cavities 84 aligned with the passages 66 of the block units for receiving the pipette tips extending below the block units 56. The lower ends of the pipette tips will rest on the shoulders 80. Also, the support members 82 have bottom protrusions 86 disposed within the channels 78 of the bottom wall 22 of the enclosure 16. Each channel 86 has a substantially semicircular configuration in transverse cross-section, though need not be so limited.

Figure 10:
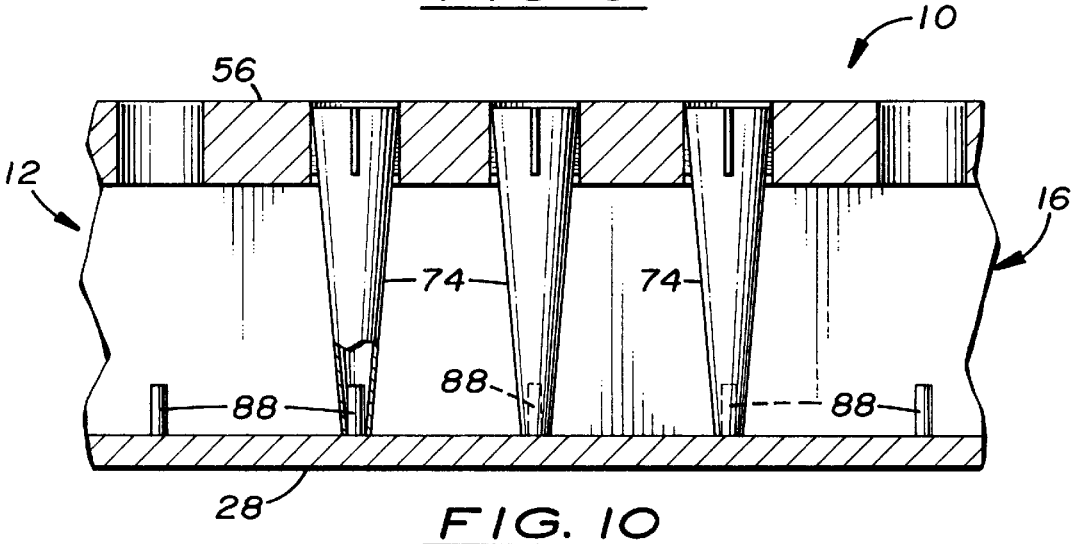
FIG. 10 is a partially sectional and partially elevational view of an alternative embodiment of the assembly showing a plurality of vertical pins supported by the bottom wall of the enclosure for fitting into open bottom ends of the wells.

The bottom wall 22 of the enclosure 16 of the support structure 12 may mount a plurality of vertical pins 88, as shown in FIG. 10. Each vertical pin 88 has a substantially cylindrical configuration, though need not be so limited. The vertical pins 88 are aligned with the passages 66 in the block units 56 for extending into the tubular wells 74 and also possibly into an open bottom of the pipette tip P for retaining the pipette tip P in an upright orientation. Each vertical pin 8 has any suitable size.

Figure 12:
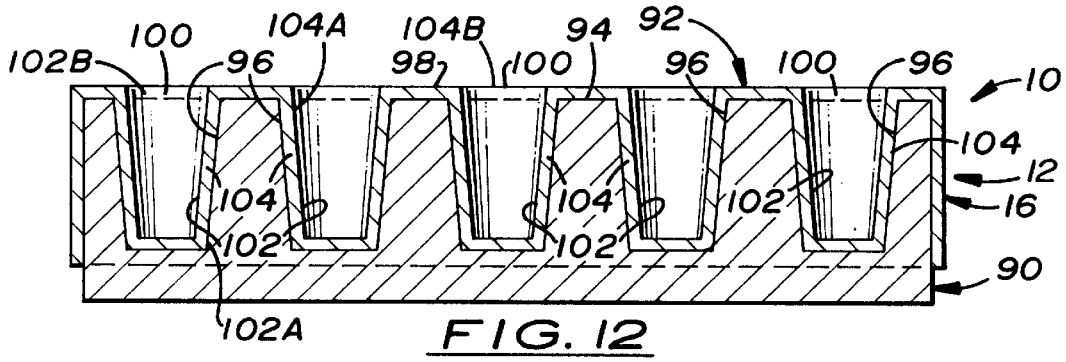
FIG. 12 is a sectional view of the assembly having a lower reusuable enclosure base and an upper disposable enclosure insert which removably fits over the lower reusable enclosure base.

Referring now to FIG. 12, there is illustated another form of the rack assembly 10 wherein the support structure 12 has two parts. The enclosure 16 of the support structure 12 includes a lower base 90 and an upper insert 92. The lower base 90 has an upper wall 94 with a plurality of openings 96 defined therein. The upper insert 92 has a top wall 98 with a plurality of openings 100 defined therein. The support structure 12 of the assembly 10 further includes a plurality of lower wells 102 disposed within the lower base 90 and a plurality of upper wells 104 disposed within the upper insert 92. The lower wells 102 are attached to and extend below the upper wall 94 of the lower base 90 with each of the lower wells 102 including a continuous side wall 102A having an open top end 102B extending around a respective one of the openings 96 in the upper wall 94 of the lower base 90. The upper wells 104 attached to and extend below the top wall 98 of the upper insert 92 with each of the upper wells 104 including a continuous side wall 104A having an open top end 104B extending around a respective one of the openings 102 in the top wall 98 of the upper insert 92. The upper insert 92 is removably installed over the lower base 90 with the upper wells 104 of the upper insert 92 nestably inserted into the lower wells 102 of the lower base 90. The upper insert 92 of the enclosure 16 12 can be a disposable component and fabricated as a thermoformed component whereas the lower base 90 of the enclosure 16 can be a reusable component and fabricated as a molded component. If desired, the upper disposable thermoformed insert 92 can be held in place on the lower reusable molded base 90 by means of detents or the like. After use, the upper thermoformed insert 92 would be physically separated from the lower reusable base 90 and discarded.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A deep well rack assembly for pipette tips, comprising:

(a) an enclosure having a top wall with a plurality of openings defined in said top wall for receiving a plurality of pipette tips and a plurality of annular depressions formed in said top wall and surrounding said openings for receiving top annular flanges of the pipette tips; and (b) a plurality of wells disposed within said enclosure and extending below said top wall thereof, each of said wells including a continuous side wall having an open top end extending around a respective one of said openings in said top wall of said enclosure, each of said wells for receiving a pipette tip such that the pipette tip is disposed through said respective one of said openings in said top wall of said enclosure and within said well with the top annular flange of the pipette tip disposed in said annular depression in said top wall of said enclosures (c) said enclosure also having a bottom wall opposite from said top wall, opposite side walls and opposite end walls extending between said opposite top and bottom walls and attached to one another and to said opposite top and bottom walls so as to provide a substantially box-like configuration and together define an interior cavity, said wells being disposed within said interior cavity of said enclosure.

2. The assembly of claim 1 wherein each of said wells also includes a bottom wall attached to and closing a bottom end of said continuous sidewall of said well.

3. A deep well rack assembly for pipette tips, comprising:

(a) an enclosure having a top wall with a plurality of openings defined in said top wall for receiving a plurality of pipette tips and a plurality of annular depressions formed in said top wall and surrounding said openings for receiving top annular flanges of the pipette tips;

(b) a plurality of wells disposed within said enclosure and extending below said top wall thereof, each of said wells including a continuous side wall having an open top end extending around a respective one of said openings in said top wall of said enclosure, each of said wells for receiving a pipette tip such that the pipette tip is disposed through said respective one of said openings in said top wall of said enclosure and within said well with the top annular flange of the pipette tip disposed in said annular depression in said top wall of said enclosure; and (c) a plurality of pipette tips each disposed through a respective one of said openings in said top wall of said enclosure and within a respective one of said wells, each of said pipette tips having a top annular flange disposed in said annular depression surrounding said respective one of said openings in said top wall of said enclosure.

4. The assembly of claim 3 wherein said top annular flange of each of said pipette tips has a top surface substantially flush with a top surface of said top wall of said enclosure.

5. The assembly of claim 3 further comprising:

a cover lying flush with and overlying a top surface of said top wall of said enclosure and overlying said pipette tips and said top annular flanges thereof disposed in said annular depressions of said top wall of said enclosure so as to cover said top wall of said enclosure and said pipette tips and wells and thereby prevent cross-contamination of said pipette tips disposed in said wells.

6. The assembly of claim 5 wherein said cover is a slidable lid mounted to said enclosure for undergoing sliding movement relative to said top wall thereof over said openings and annular depressions therein.

7. The assembly of claim 5 wherein said cover is comprised of a layer of film disposed over said top wall of said enclosure.

8. The assembly of claim 3 wherein said cover is a slidable lid mounted to said enclosure for undergoing sliding movement relative to said top wall thereof over said openings and annular depressions therein.

9. The assembly of claim 3 wherein:

said top wall of said enclosure has a pair of opposite side edges; and said slidable lid has opposite inturned side ledges each having a substantially U-shaped configuration and defining a groove which captures one of said side edges of said top wall, said side ledges being slidably movable along said side edges of said top wall as said lid is slidably moved relative to said top wall.

10. The assembly of claim 3 wherein said cover is comprised of a layer of film disposed over said top wall of said enclosure.

11. The assembly of claim 10 wherein said layer of film is applied over and attached to portions of said top wall of said enclosure between said openings and annular depressions in said top wall in order to ensure sterility of each of the pipette tips disposed within said wells until the pipette tip is used.

12. The assembly of claim 10 wherein said layer of film has a plurality of targets printed thereon, each said target being disposed directly above one of said openings in said top wall of said enclosure and thereby marking a location where said layer of film should be pierced to gain access to one of said wells containing one of the pipette tips such that the one pipette tip may be fitted onto an end of a pipette.

13. The assembly of claim 10 wherein said layer of film includes a first membrane layer portion disposed over said top wall of said enclosure and a second membrane layer portion disposed over and releasably attached to said first membrane layer portion such that said second membrane layer portion can be peeled away from said first membrane layer portion and said first membrane layer portion then pierced such that the pipette tip disposed in said one well therebelow may be fitted onto an end of a pipette.

14. A deep well rack assembly for pipette tips, comprising:

(a) an enclosure having a top wall with a plurality of openings defined in said top wall for receiving a plurality of pipette tips and a plurality of raised annular rings formed on said top wall and surrounding said openings and protruding above said top wall; and (b) a plurality of wells disposed within said enclosure and extending below said top wall of said enclosure, each of said wells including a continuous side wall having an open top end extending around a respective one of said openings in said top wall of said enclosure, each of said wells for receiving a pipette tip such that the pipette tip is disposed through said respective one of said openings in said top wall of said enclosure below a top surface of said raised annular ring and within said well.

15. The assembly of claim 14 wherein said enclosure also has a bottom wall opposite from said top wall, opposite side walls and opposite end walls extending between said opposite top and bottom walls and attached to one another and to said opposite top and bottom walls so as to provide a substantially box-like configuration and together define an interior cavity, said wells being disposed within said interior cavity of said enclosure.

16. The assembly of claim 14 wherein each of said wells also includes a bottom wall attached to and closing a bottom end of said continuous sidewall of said well.

17. The assembly of claim 14 further comprising:

a plurality of pipette tips each disposed through said respective one of said openings in said top wall of said enclosure and within a respective one of said wells, each of said pipette tips having a top end disposed below said top surface of each of said raised annular rings on said top wall of said enclosure.

18. The assembly of claim 17 further comprising:

a cover overlying a top surface of said top wall of said enclosure and said top surfaces of said raised annular rings on said top wall of said enclosure so as to cover said top wall of said enclosure and said raised annular rings thereon and said pipette tips and wells and thereby prevent cross-contamination of said pipette tips disposed in said wells.

19. The assembly of claim 18 wherein said cover is a slidable lid mounted to said enclosure for undergoing sliding movement relative to said top wall thereof over said openings and said raised annular rings of said top wall.

20. The assembly of claim 18 wherein said cover is comprised of a layer of film disposed over said top wall of said enclosure.

21. The assembly of claim 14 further comprising:

a cover overlying a top surface of said top wall of said enclosure and said top surfaces of said raised annular rings on said top wall of said enclosure so as to cover said top wall of said enclosure and said raised annular rings thereon and said pipette tips and wells and thereby prevent cross-contamination of the pipette tips disposed in said wells.

22. The assembly of claim 21 wherein said cover is a slidable lid mounted to said enclosure for undergoing sliding movement relative to said top wall thereof over said openings and said raised annular rings of said top wall.

23. The assembly of claim 22 wherein:

said top wall of said enclosure has a pair of opposite side edges; and said slidable lid has opposite inturned side ledges each having a substantially U-shaped configuration and defining a groove which captures one of said side edges of said top wall, said side ledges being slidably movable along said side edges of said top wall as said lid is slidably moved relative to said top wall.

24. The assembly of claim 21 wherein said cover is comprised of a layer of film disposed over said top wall of said enclosure.

25. The assembly of claim 24 wherein said layer of film is applied over and attached to top surfaces of said raised annular rings on said top wall of said enclosure surrounding said openings in said top wall in order to ensure sterility of each of the pipette tips disposed within said wells until the pipette tip is used.

26. The assembly of claim 24 wherein said layer of film has a plurality of targets printed thereon, each said target being disposed directly above one of said openings in said top wall of said enclosure and thereby marking a location where said layer of film should be pierced to gain access to one of said wells containing one of the pipette tips such that the one pipette tip may be fitted onto an end of a pipette.

27. The assembly of claim 24 wherein said layer of film includes a first membrane layer portion disposed over said top wall of said enclosure and a second membrane layer portion disposed over and releasably attached to said first membrane layer portion such that said second membrane layer portion can be peeled away from said first membrane layer portion and said first membrane layer portion then pierced such that the pipette tip disposed in said one well therebelow may be fitted onto an end of a pipette.

28. A deep well rack assembly for pipette tips, comprising:

(a) an enclosure having a top surface and a plurality of openings defined through said top wall;

(b) a plurality of wells disposed within said enclosure and attached to and extending below said top surface of said enclosure, each of said wells including a continuous side wall having an open top end extending around a respective one of said openings in said top wall of said enclosure;

(c) a cover lying flush with and overlying a top surface of said top wall of said enclosure and overlying said openings and wells so as to cover said top wall of said enclosure and wells and thereby prevent cross-contamination between said wells; and (d) a plurality of pipette tips each disposed wholly within one of said wells below said top surface of said top wall and covered by said cover.

29. The assembly of claim 28 wherein each of said wells also includes a bottom wall attached to and closing a bottom end of said continuous sidewall of said well.

30. The assembly of claim 28 wherein said enclosure has a bottom wall spaced from said top wall and including means for fitting with bottom ends of said wells.

31. The assembly of claim 30 wherein said fitting means is a plurality of recesses formed in said bottom wall and aligned with said openings in said top wall of said enclosure.

32. The assembly of claim 30 wherein said fitting means is a plurality of pins mounted on said bottom wall and aligned with said openings in said top wall of said enclosure for fitting into open bottom ends of said wells.

33. The assembly of claim 28 wherein said cover is a slidable lid mounted to said enclosure for undergoing sliding movement relative to said top wall thereof over said openings therein.

34. The assembly of claim 33 wherein:

said top wall of said enclosure has a pair of opposite side edges; and said slidable lid has opposite inturned side ledges each having a substantially U-shaped configuration and defining a groove which captures one of said side edges of said top wall, said side ledges being slidably movable along said side edges of said top wall as said lid is slidably moved relative to said top wall.

35. The assembly of claim 28 wherein said cover is comprised of a layer of film disposed over said top wall of said enclosure.

36. The assembly of claim 35 wherein:

said layer of film is adapted to be fractured and pierced by an end of a pipette applied thereagainst at portions of said layer of film overlying said openings in said top wall of said enclosure; and said pipette tips are disposed in said wells such that a top end of each of said pipette tips is displaced a sufficient distance below a respective one of said openings in said top wall of said enclosure to permit fitting of the end of the pipette with said pipette tip without insertion of any fractured portions of said layer of film into said pipette tip.

37. The assembly of claim 35 wherein said layer of film has a plurality of targets printed thereon, each said target being disposed directly above one of said openings in said top wall of said enclosure and thereby marking said portion where said layer of film should be pierced to gain access to one of said wells containing one of the pipette tips such that said one pipette tip may be fitted onto an end of a pipette.

38. The assembly of claim 35 wherein said layer of film is applied over and attached to portions of said top surface of said top wall of said enclosure between said openings in said top wall in order to ensure sterility of each of said pipette tips disposed within said wells until said pipette tip is used.

39. The assembly of claim 35 wherein said layer of film includes a first membrane layer portion disposed over said top wall of said enclosure and a second membrane layer portion disposed over and releasably attached to said first membrane layer portion such that said second membrane layer portion can be peeled away from said first membrane layer portion and said first membrane layer portion then pierced such that the pipette tip disposed in said one well therebelow may be fitted onto an end of a pipette.

* * * * *